US008879779B2

(12) United States Patent
He

(10) Patent No.: US 8,879,779 B2
(45) Date of Patent: Nov. 4, 2014

(54) MICRO-SPEAKER

(71) Applicant: Jin He, Shenzhen (CN)

(72) Inventor: Jin He, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 18 days.

(21) Appl. No.: 13/748,087

(22) Filed: Jan. 23, 2013

(65) Prior Publication Data

US 2013/0329937 A1 Dec. 12, 2013

(30) Foreign Application Priority Data

Jun. 11, 2012 (CN) ..... 2012 2 0273608

(51) Int. Cl.
*H04R 25/00* (2006.01)

(52) U.S. Cl.
USPC ..... 381/406; 381/401

(58) Field of Classification Search
USPC ..... 381/396, 398, 400, 404, 412, 431, 433, 381/401, 406
See application file for complete search history.

(56) References Cited

U.S. PATENT DOCUMENTS

| | | | | |
|---|---|---|---|---|
| 6,639,994 | B1 * | 10/2003 | Proni et al. | 381/406 |
| 6,801,635 | B1 * | 10/2004 | Minami et al. | 381/406 |
| 7,209,570 | B2 * | 4/2007 | Funahashi et al. | 381/398 |
| 7,292,707 | B2 * | 11/2007 | Kreitmeier et al. | 381/398 |
| 7,542,583 | B2 * | 6/2009 | Funahashi | 381/398 |
| 7,570,774 | B2 * | 8/2009 | Jeong et al. | 381/433 |
| 8,045,745 | B2 * | 10/2011 | Horigome et al. | 381/398 |
| 8,249,290 | B2 * | 8/2012 | Funahashi | 381/398 |
| 2003/0185415 | A1 * | 10/2003 | Funahashi et al. | 381/398 |
| 2005/0141746 | A1 * | 6/2005 | Kobayashi et al. | 381/398 |
| 2005/0201588 | A1 * | 9/2005 | Funahashi et al. | 381/398 |

* cited by examiner

*Primary Examiner* — Suhan Ni

(74) *Attorney, Agent, or Firm* — Anova Law Group, PLLC

(57) ABSTRACT

Disclosed is a micro-speaker. A micro-speaker includes a frame, a magnetic circuit unit accommodating in the frame, a vibrating unit, an assistant coil attached to the frame and disposed below the diaphragm. The vibrating unit includes a diaphragm and a voice coil driving the diaphragm. The assistant coil includes an upper surface facing the diaphragm and an inclined surface connecting the upper surface and disposed closer to the voice coil than the upper surface.

16 Claims, 3 Drawing Sheets

MICRO-SPEAKER

FIELD OF THE INVENTION

The present disclosure relates to the art of speakers, particularly to a micro-speaker used in an electronic device.

DESCRIPTION OF RELATED ART

With the rapid development of the wireless communication, cellular phones are widely used, especially that the third generation of mobile telecommunications technology (3G) brings a fast expand of the mobile multimedia technology. People request for more functions besides basic talk, such as video play, digital camera, game, or hearing aid. A speaker provided with hearing aid function is usually used in a cellular phone.

The related speaker includes a frame, a diaphragm, a voice coil, a magnetic circuit unit retained in the frame and driving the voice coil and the diaphragm to vibrate and generate sound. The speaker further includes an assistant coil for achieving the hearing aid function. The assistant coil is embedded in the speaker and has a performance corresponding with a width of the assistant coil. However, the speaker is very small and has a small inner space, which makes the vibrating diaphragm easy to hit the assistant coil and influence the performance of the speaker.

Therefore, it is desirable to provide a micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

Figure 1:
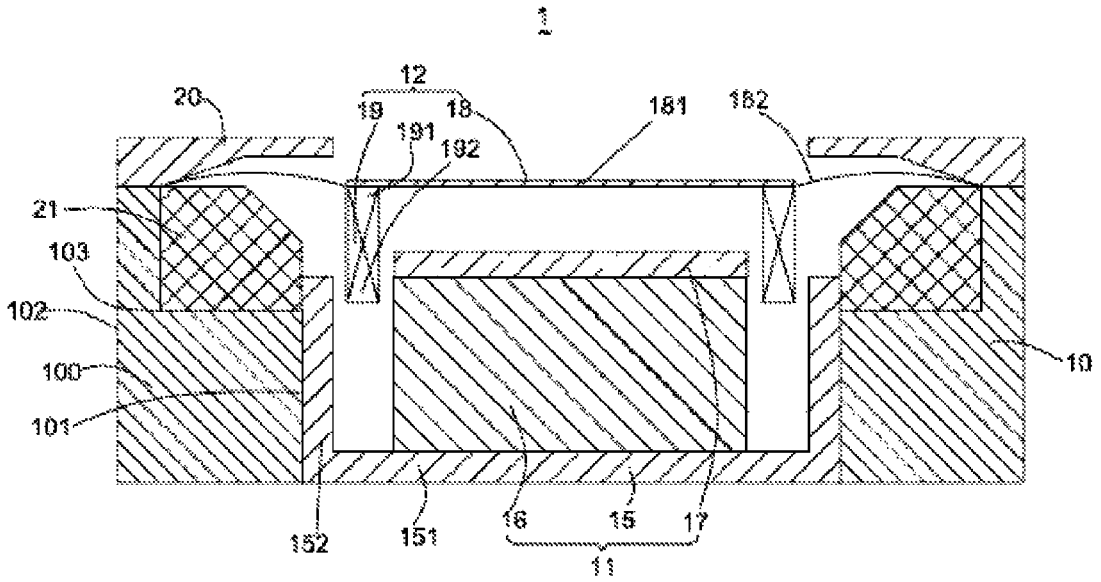
FIG. 1 is a cross-sectional view of a micro-speaker according to an exemplary embodiment of the present disclosure.

Referring to FIG. 1, a speaker 1 includes a frame 10, a magnetic circuit unit 11 accommodated in the frame 10, a vibrating unit 12 suspended by the frame 10, a front cover 20 forming a receiving space with the frame 10, and an assistant coil 21.

The magnetic circuit unit 11 includes a yoke 15 with a base 151 and a sidewall 152 extending from the base 151, a magnet 16 disposed on the base 151, and a pole plate 17 attached to the magnet 16. The vibrating unit 12 includes a diaphragm 18 and a voice coil 19 driving the diaphragm 18 to generate sound. The diaphragm 18 is provided with a top plate 181 and a periphery portion 182 surrounding the top plate 181 with a convex surface. The periphery portion 182 further includes an outer fringe attached to the frame 10. The voice coil 19 includes a first end 191 attached to the top plate 181 and a second end 192 disposed in a magnetic gap formed by the yoke 15 and the magnet 16. In this embodiment, the yoke is bowl-shaped and includes a sidewall. The magnetic gap is formed between the sidewall and the magnet. In optional cases, the yoke may only include a base without the sidewall, and the magnetic gap may be formed between two adjacent magnets located on the base; or the yoke may include a base and a central core extending from the base, and the magnetic gap may be formed between the core and a ring-shaped magnet surrounding the core. In a word, the shape of the yoke is not restricted and it is feasible as long as the yoke includes a base for carrying a magnet.

Figure 2:
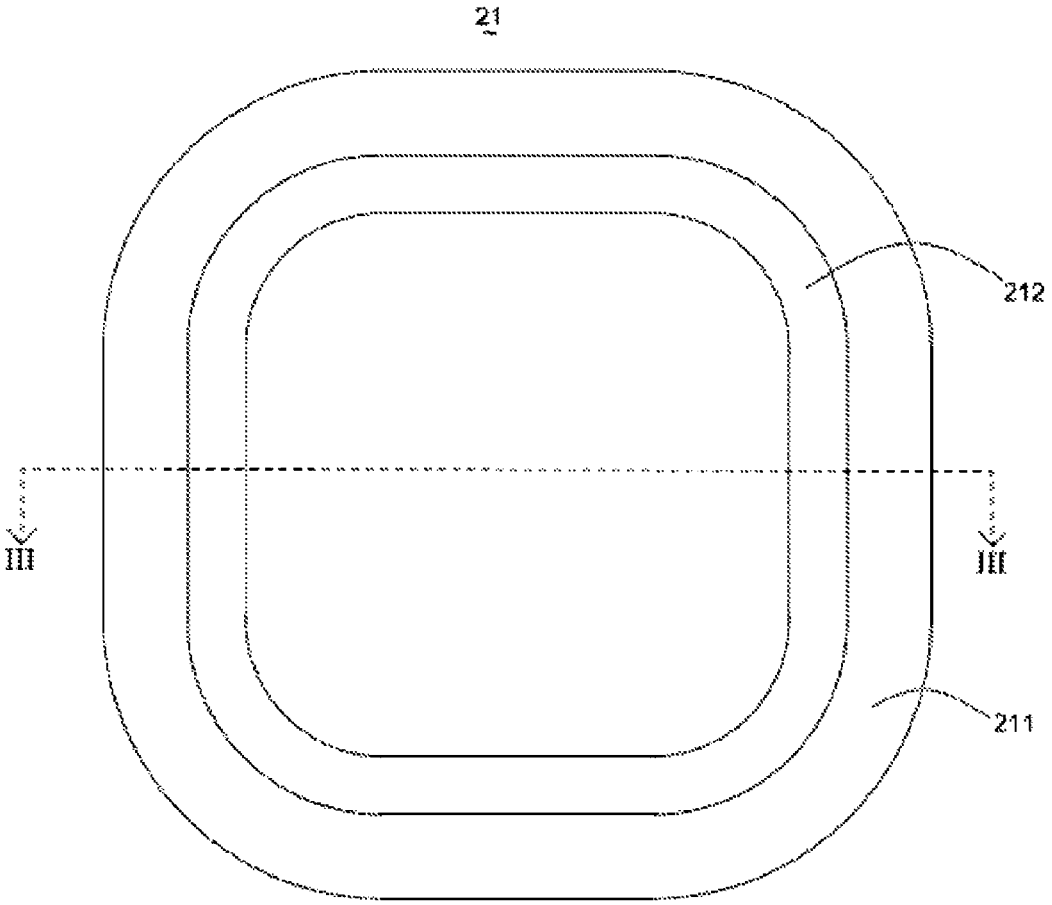
FIG. 2 is an enlarged view of an assistant coil of the micro-speaker of FIG. 1.
Figure 3:
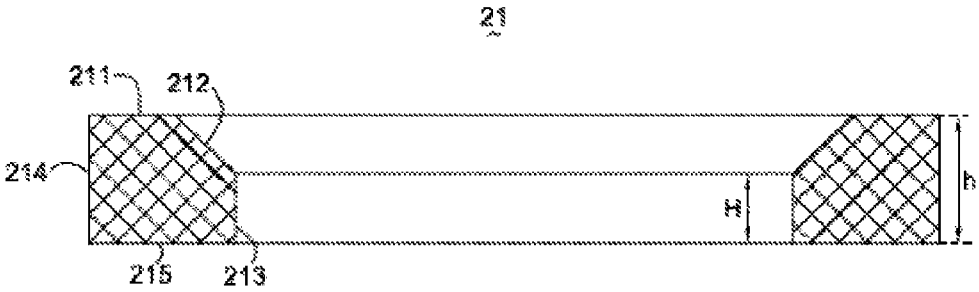
FIG. 3 is a cross-sectional view of the assistant coil taken along line III-III of FIG. 2.

Referring to FIGS. 2 and 3, the assistant coil 21 has a ring-shaped outline and a pentagon-shaped cross section. The assistant coil 21 is located between the diaphragm 18 and the frame 10, and surrounds around the yoke 15. The assistant coil 21 includes an inner surface 213, an outer surface 214 opposite to the inner surface 213, a bottom surface 215 connecting the inner surface 213 and the outer surface 214. The assistant coil 21 further includes an upper surface 211 parallel to the bottom surface and an inclined surface 212 extending from the upper surface 211 to the inner surface 213. The inclined surface 212 is disposed at an inner fringe of the assistant coil 21. The upper surface 211 faces the diaphragm 12. The joint of the inclined surface 212 and the upper surface 211 is farther from the voice coil 19 than the joint of the inner surface 213 and the inclined surface 212. A first height H of the inner surface 211 is smaller than a second height h of the outer surface 214. In other embodiments, the inclined surface 212 may be concaved or convex.

The frame 10 includes a wall 100 for retaining the magnetic circuit unit 11. The wall 100 includes an inner face 101, an outer face 102 opposite to the inner face 101, and a slot 103 concaved from the inner face 101 to the outer face 102 for receiving the assistant coil 21. The inner surface 213 of the assistant coil 21 is optionally disposed in a same plane with the inner face 101 of the wall 100. The side wall 152 of the yoke 15 is optionally attached to the inner face 101 and the inner surface 213. The upper surface 211 of the assistant coil 21 is optionally disposed in a same plane with an upper face of the wall 100.

The assistant coil 19 is located below the periphery portion 182, and the assistant coil 19 will not hit the diaphragm 18 while the diaphragm 18 vibrating by virtue of the inclined surface 212. And the width of the assistant coil 19 does not need to be decreased, which makes the speaker 1 provide a good performance of hearing aid.

The front cover 20 is attached to the upper face of the wall 100 for pressing on the outer fringe of the diaphragm 18. The magnetic circuit unit 11 is retained in the frame.

It will be understood that the above-mentioned particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker, comprising a frame, a magnetic circuit unit accommodated in the frame;

a vibrating unit, including a diaphragm and a voice coil driving the diaphragm;

an assistant coil attached to the frame and disposed below the diaphragm; wherein the assistant coil includes an upper surface facing the diaphragm, a bottom surface located on the frame, an inner surface facing the voice coil, and an inclined surface connecting the upper surface to the inner surface; and wherein the joint of the upper surface and the inclined surface is farther from the voice coil than the joint of the inclined surface and the inner surface.

2. The micro-speaker as claimed in claim 1, wherein the frame includes a wall with an inner face, an outer face opposite to the inner face, and a slot concaved from the inner face to the outer face for receiving the assistant coil.

3. The micro-speaker as claimed in claim 2, wherein a first height of the inner surface is smaller than a second height of the outer surface.

4. The micro-speaker as claimed in claim 3, wherein the diaphragm includes a top plate and a periphery portion surrounding the top plate, the voice coil is attached to the top plate, the assistant coil is disposed under the periphery portion.

5. The micro-speaker as claimed in claim 4, wherein the upper surface of the assistant coil is disposed in a same plane with a top face of the wall of the frame.

6. The micro-speaker as claimed in claim 5, wherein the magnetic circuit unit includes a yoke having a base and a sidewall extending from the base, and the inner surface abuts against the sidewall of the yoke.

7. A micro-speaker, comprising a frame including a slot disposed at an inner face thereof;

a magnetic circuit unit accommodating in the frame;

a vibrating unit, including a diaphragm and a voice coil driving the diaphragm;

an assistant coil received in the slot of the frame; wherein the assistant coil includes an inner surface facing the voice coil, and an outer surface facing the frame, the inner surface has a first height and the outer surface has a second height greater than the first height.

8. The micro-speaker as claimed in claim 7, wherein the assistant coil includes a bottom surface connecting the inner surface and the outer surface, an upper surface parallel to the bottom surface and an inclined surface extending from the upper surface to the inner surface.

9. The micro-speaker as claimed in claim 7, wherein the diaphragm includes a top plate and a periphery portion surrounding the top plate, the inclined surface is disposed below the periphery portion.

10. A speaker, comprising a frame;

a magnetic circuit unit accommodated in the frame;

a vibrating unit, including a diaphragm and a voice coil driving the diaphragm;

an assistant coil fixed to the frame and disposed below the diaphragm; wherein the assistant coil includes an inner surface with a first height and an outer surface with a second height greater than the first height.

11. The micro-speaker as claimed in claim 10, wherein the assistant coil includes an upper surface, a bottom surface parallel to the upper surface, and an inclined surface extending downwards from the upper surface to the inner surface.

12. The micro-speaker as claimed in claim 11, wherein the frame includes a wall with a slot for receiving the assistant coil.

13. The micro-speaker as claimed in claim 12, wherein the upper surface of the assistant coil is disposed in a same plane with an upper face of the wall.

14. The micro-speaker as claimed in claim 13, wherein the magnetic circuit unit includes a yoke with a base and a sidewall, a magnet disposed on the base, and a pole plate attached to the magnet.

15. The micro-speaker as claimed in claim 14, wherein the sidewall of the yoke is attached to an inner face of the wall of the frame.

16. The micro-speaker as claimed in claim 15, wherein the assistant coil is surrounding around the sidewall of the yoke.

* * * * *